United States Patent [19]

Odagaki

[11] Patent Number: 5,006,757

[45] Date of Patent: Apr. 9, 1991

[54] INCANDESCENT LAMP

[75] Inventor: Toru Odagaki, Okayama, Japan

[73] Assignee: Ushio Denki Kabushiki Kaisha, Tokyo, Japan

[21] Appl. No.: 448,327

[22] Filed: Dec. 11, 1989

[51] Int. Cl.[5] ..... H01J 17/18; H01J 5/50; H01K 1/42

[52] U.S. Cl. ..... 313/623; 313/318; 313/273; 313/634; 439/612; 439/619

[58] Field of Search ..... 313/273, 279, 318, 315, 313/313, 634, 636, 623, 569, 573, 578; 439/611, 612, 619, 541, 182

[56] References Cited

U.S. PATENT DOCUMENTS

| | | | |
|---|---|---|---|
| 1,158,928 | 11/1915 | Keyes | 313/318 |
| 3,870,393 | 3/1975 | Hill | 439/611 |
| 3,983,441 | 9/1976 | Northrup | 313/273 |
| 4,825,125 | 4/1989 | Lagushenko et al. | 313/634 |

FOREIGN PATENT DOCUMENTS 63-72845 5/1988 Japan .

*Primary Examiner*—Sandra L. Oshea

*Assistant Examiner*—Diab Hamadi

*Attorney, Agent, or Firm*—Finnegan, Henderson, Farabow, Garrett & Dunner

[57] ABSTRACT

An incandescent lamp comprises a glass envelope, a filament supported by constricted portions of the glass envelope, lead rods extending from both ends of the filament, tapered constricted portions at both ends of the glass tube to provide sealing portions by which the lead rods are surrounded respectively, and contacts connected to the outer ends of the lead rods respectively. The sealing ports are formed in such a manner that their outer diameters are equal to or smaller than those of the respective contacts, cylindrical bases are arranged so as to enclose the respective contacts, portions of the lead rods which project out of the sealing portions, and the sealing portions, and to be in contact with the respective tapered portions following the sealing portions, and fixing cement is filled in the bases. As a result of this construction, it is possible to shorten the length of the sealing portions so as to make the effective emission length of the incandescent lamp sufficiently long and to hold it stably without any breaks of the sealing portions.

6 Claims, 2 Drawing Sheets

INCANDESCENT LAMP

BACKGROUND OF THE INVENTION

1. Field of the Invention

This invention relates to an incandescent lamp comprising a glass envelope, a filament supported by constricted portions of the glass envelope, lead rods provided at both ends of the filament and sealing portions formed respectively by constricting portions of the glass tube, which surround the lead rods.

2. Description of the Related Art

In one example of double-end-sealed tube type incandescent lamps which have been used in the light sources for exposure of copying machines by way of example, an incandescent lamp is constructed in the following manner with reference to FIG. 4 of the drawings. A filament assembly composed of a filament 20 comprising light-emitting parts 21 and light-unemitting parts 22, which are arranged alternately, inner leads 71 connected to both ends of the filament 20 respectively, hermetically-sealing metal foils 72 connected to the inner leads 71 respectively, and outer leads 73 connected to the metal foils 72 respectively is disposed in a glass tube 70 made of quartz glass as illustrated in FIG. 4. Sealing portions 74 are formed by pinching portions of the glass tube 70, which surround the metal foils 72 respectively, to the metal foils 72 under heating and pressing. Contacts 40 are connected respectively to the outer leads 73 projecting out of the sealing portions 74. Cylindrical bases 50 are respectively arranged so as to surround the contacts 40 and exposed portions of the outer leads 73 and are fixed thereon with a cement 60 filled in each base 50.

Such conventional incandescent lamps are however accompanied by the following problems.

(1) Since each sealing portion is formed by making use of the metal foil 72, the sealing portion becomes longer. It is therefore impossible to make the effective emission length of the filament 20 sufficiently long to extend for the whole length of the incandescent lamp. It is hence difficult to shorten the whole length of the incandescent lamp.

In addition, since it is impossible to make the effective emission length sufficiently long as described above, a dimmer is required to obtain a desired luminous intensity distribution. The cost of equipment hence becomes higher.

(2) The contact type incandescent lamp such as described above is supplied with electricity through feeding means coming into contact with the external surfaces of both contacts 40 and inwardly pressing them while being held therebetween under pressure. However, since the sealing portions 74 are long and are formed thinly by pinching under heating and pressing, the strength of the sealing portions 74 becomes insufficient, whereby troubles such as breaks at the sealing portions arise.

SUMMARY OF THE INVENTION

With the foregoing circumstances in view, the present invention has been made and has as its object the provision of an incandescent lamp capable of shortening the length of sealing portions to make its effective emission length sufficiently long and holding it stably without any breaks of the sealing portions.

In one aspect of this invention, there is thus provided an incandescent lamp comprising a glass envelope, a filament supported by constricted portions of the glass envelope, lead rods extending from both ends of the filament, sealing portions formed respectively through tapered portions of the constricted portions of the glass tube, by which the lead rods are surrounded respectively, and contacts connected to the outer ends of the lead rods respectively. The sealing portions are formed in such a manner that their outer diameters are equal to or smaller than those of the respective contacts. Cylindrical bases are arranged so as to enclose the respective contacts, portions of the lead rods, which project out of the sealing portions, and the sealing portions, and to come at their inner ends into contact with the respective tapered portions following the sealing portions, and a fixing cement is filled in the bases.

Owing to the incandescent lamp of the above construction according to this invention, the required length of the sealing portions can be made considerably short because the sealing portions are respectively formed through the tapered portions by constricting portions of the glass tube, by which the lead rods are surrounded respectively. It is hence possible to sufficiently shorten the length of the incandescent lamp while assuring that the effective emission length of the filament is made sufficiently long and to greatly contribute to economy in installation space in equipments.

In addition, each cylindrical base can be disposed by pushing it from the side of the contact until it comes into contact with the tapered portion following each sealing portion because the sealing portion is formed in such a way that its outer diameter is equal to or smaller than that of the contact. Furthermore, it is possible to fix the base to the sealing portion with sufficient strength because the base is fixed by filling a fixing cement therein, and it is possible to assure that the breakage of the sealing portion is avoided since the required length of the sealing portion may be short. As a result, the incandescent lamp can be held stably.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
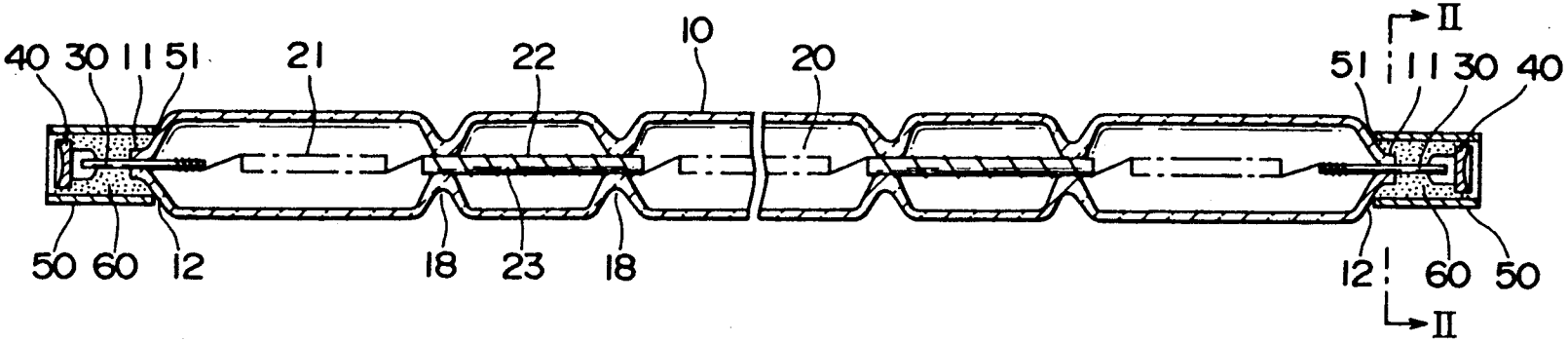
FIG. 1 is an explanatory cross-sectional view showing an incandescent lamp according to one embodiment of this invention.

The embodiments of this invention will hereinafter be described specifically referring to the drawings.

FIG. 1 is an explanatory drawing showing an incandescent lamp according to one embodiment of this invention. Numerals 10, 20, 30, 40, 50 and 60 indicate a glass envelope formed from a glass tube, a filament, a lead rod, a contact, a cylindrical base and a cement respectively.

Figure 2:
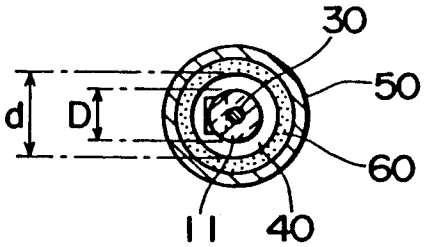
FIG. 2 is an explanatory transverse cross-sectional view showing principal parts of the incandescent lamp according to this invention, taken along the line II—II of FIG. 1.

In the incandescent lamp of this embodiment, the filament 20 is held by a plurality of constricted portions 18 for supporting the filament, which have been formed in the glass envelope 10, so as to extend along the axis of the tube. Each sealing portion 11 is formed through a tapered portion 12 by constricting a portion of the glass tube made of a hard glass by way of example, by which the lead rod 30 made of, for example, molybdenum, which has been provided so as to extend from the corresponding end of the filament 20, is surrounded, for example, by heating. The lead rod 30 is fusion-bonded hermetically to the sealing portion 11. A contact 40 is connected to the outer end of each lead rod 30, for example, by welding. As also illustrated in FIG. 2, each sealing portion 11 is formed in such a manner that its outer diameter D is equal to or smaller than the outer diameter d of the contact 40. Each cylindrical base 50 made of, for example, ceramic is arranged so as to enclose the contact 40, a portion of the lead rod 30, which projects out of the sealing portion 11, and the sealing portion 11 and to come at its inner end 51 into contact with the tapered portion 12 following the sealing portion 12 is disposed, and is fixed to the envelope 10 with the fixing cement 60, such as heat-resistant inorganic cement, filled therein.

The term "constricted portion" as used herein means a portion at which the tube wall of the glass envelope 10 is in a shape partly narrowed down so as to be close to the tube axis when seeing the glass envelope 10 from the direction of the tube axis.

The filament 20 is composed of light-emitting parts 21 and light-unemitting parts 22, which are arranged alternately. Each of the light-emitting parts 21 is formed of a close-winding coil part, while each of the light-unemitting parts 22 is formed of a loose-winding coil part and a short-circuit rod 23 inserted therein. A coil body composed of the close-winding coil parts and the loose-winding parts is made of tungsten by way of example. The filament 20 is held at both ends of each light-unemitting part 22 by the constricted portions 18 for supporting the filament.

Figure 3:
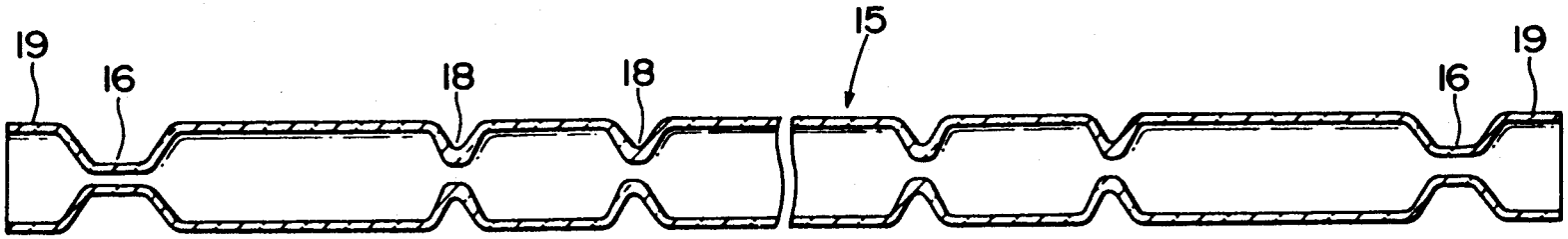
FIG. 3 is an explanatory cross-sectional view showing one example of glass tubes suitable for use in forming an envelope.
Figure 4:
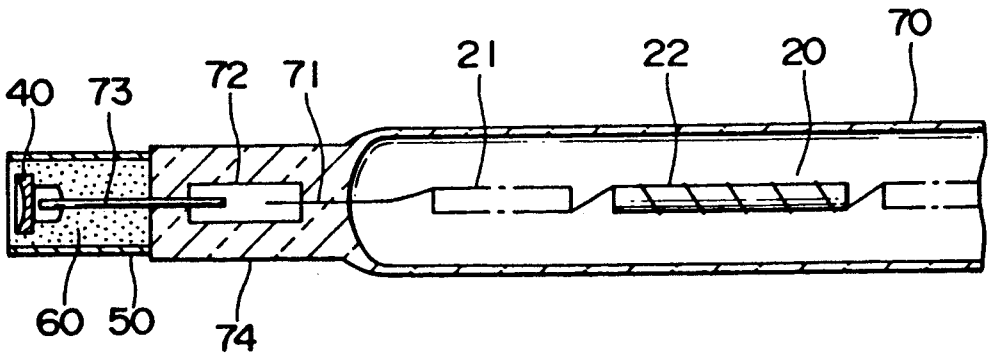
FIG. 4 is an explanatory cross-sectional view showing one example of conventional incandescent lamps.

The glass tube for forming the glass envelope 10 is made of alumina-silicate hard glass. As illustrated in FIG. 3, a glass tube 15, in which a plurality of constricted portions 18 for supporting the filament and other constricted portions 16 for forming respective sealing portions on the vicinities of both ends have been formed in advance, is used. Namely, it is possible to hermetically fusion-bond lead rods 30 to the respective constricted portions 16 within a relativly short period of time by inserting the filament 20 having the lead rods 30 at its both ends into the glass tube 15 from one end thereof so as to position a part of each lead rod to be surrounded by the constricted portion 16 for the sealing portion and then separately heating the constricted portions 16 for the sealing portions. Accordingly, the following advantages can be obtained. The deterioration of the lead rods 30 by oxidation due to heating can be repressed to a considerable extent. There is no potential problem that the use-life of the lead rods 30 is shortened. In addition, it is surely achievable to weld the lead rod 30 with the contact 40. Incidentally, portions 19 of the glass tube 15, which are situated respectively on the outsides of the constricted portions 16 for the sealing portions, are cut away at suitable positions after the formation of the sealing portions 11.

In the above-described incandescent lamp, the lengths of the sealing portions 11 in the axial direction are preferably at least 5 mm respectively because so-called slow leak is prevented from occurring. The slow leak is caused by a great number of fine concave grooves existing in the peripheral surface of the lead rods 30, which are generally produced by wire drawing, and extending in a longitudinal direction.

Each cylindrical bases 50 is smaller in diameter than the glass envelope 10, is of a cylindrical form having openings at its both ends and is fixed in a state kept at its inner end 51 in contact with the tapered portion 12 following the sealing portion 11.

As the cement 60, is used suitably a cement which comprises, as principal components, aluminum oxide and silicon dioxide, contains 2 wt. % or less of alkali metal oxides and has a coefficient of expansion in a range of $20\times10^{-7}$–$60\times10^{-7}$/°C. after drying.

Since such a specific cement is small in content of alkali metal oxides, it is possible to prevent for example, $Na^+$ in the cement from reacting with Si in the light-emitting tube 10 made of alumina-silicate hard glass to form a layer of a compound formed therefrom on the surface of the light-emitting tube 10. Moreover, since the coefficient of expansion of the cement is approximate to the coefficient of expansion (about $25\times10^{-7}$–$65\times10^{-7}$/°C.) of the alumina-silicate hard glass, the adhesion of the cement to the glass remains good even when they undergo changes in temperature due to repeated lighting and lights-out of the incandescent lamp. As a result, no separation and/or cracks of the glass occur at the contact portions of the cement and the glass-made light-emitting tube and the bond strength of the base and the glass-made light-emitting tube becomes sufficiently high. It is hence possible to obtain an incandescent lamp high in reliability.

The following composition is an example of compositions of such cements.

| | |
|---|---|
| $Na_2O$ | 1 wt. % |
| $Al_2O_3$ | 52 wt. % |
| $SiO_2$ | 31 wt. % |
| $K_2O$ | 1 wt. % or less |
| $TiO_2$ | 5 wt. % |
| $ZrO_2$ | 10 wt. % |

This cement contains 2 wt. % or less of alkali metal oxides, and has a coefficient of expansion of $40\times10^{-7}$/°C. after drying.

As commercially-available cements suitable for use in this invention, may be mentioned "Bond X" (product of Nissan Chemical Industries, Ltd.) and the like.

Having now fully described the invention, it will be apparent to one of ordinary skill in the art that many changes and modifications can be made thereto without departing from the spirit or scope of the invention as set forth herein.

What is claimed is:

1. In an incandescent lamp comprising a glass envelope, a filament supported by constricted portions of the glass envelope, lead rods extending from both ends of the filament, tapered constricted portions at both ends of the glass tube to provide sealing portions by which the lead rods are surrounded respectively, and contacts connected to the outer ends of the lead rods respectively, the improvement wherein the sealing portions are formed in such a manner that their outer diameters are equal to or smaller than those of the respective contact, cylindrical bases are arranged so as to enclose the respective contacts, portions of the lead rods which project out of the sealing portions, and the sealing portions, and to be in contact at the inner ends thereof with the respective tapered constricted portions following the sealing portions, and a fixing cement is filled in the bases.

2. The incandescent lamp as claimed in claim 1, wherein the filament is formed of a coil body having close-winding coil parts and loose-winding coil parts, and short-circuit rods inserted in the loose-winding coil parts, light-emitting parts formed of the close-winding coil parts and light-unemitting parts formed of the loose-winding coil parts are arranged alternately, and the filament is held at both ends of the respective light-unemitting parts by the constricted portions for supporting the filament formed in the envelope.

3. The incandescent lamp as claimed in claim 1, wherein the envelope is formed of a tube of alumina-silicate hard glass.

4. The incandescent lamp as claimed in claim 3, wherein the fixing cement comprises, as principal components, aluminum oxide and silicon dioxide, contains at most 2 wt. % of alkali metal oxide and has a coefficient of expansion in a range of $20\times10^{-7}$–$60\times10^{-7}$/°C. after drying.

5. The incandescent lamp as claimed in claim 3, wherein the lead rods are made of molybdenum.

6. The incandescent lamp as claimed in claim 1, wherein the envelope is formed by inserting the filament having the lead rods at both ends thereof into a glass tube in which a plurality of constricted portions for supporting the filament and other constricted portions for forming the respective sealing portions on the both ends have been formed in advance and then heating respectively the constricted portions for forming the sealing portions, thereby hermetically fusion-bonding them to the lead rods.

* * * * *